US007735218B2

(12) United States Patent
Bouman

(10) Patent No.: US 7,735,218 B2
(45) Date of Patent: Jun. 15, 2010

(54) RIVET DELIVERY APPARATUS AND METHOD

(75) Inventor: Wim Bouman, Toronto (CA)

(73) Assignee: Acument Intellectual Properties, LLC, Troy, MI (US)

( * ) Notice: Subject to any disclaimer, the term of this patent is extended or adjusted under 35 U.S.C. 154(b) by 692 days.

(21) Appl. No.: 11/369,419

(22) Filed: Mar. 7, 2006

(65) Prior Publication Data

US 2006/0201988 A1 Sep. 14, 2006

Related U.S. Application Data

(60) Provisional application No. 60/661,276, filed on Mar. 11, 2005.

(51) Int. Cl.
*B23Q 7/10* (2006.01)

(52) U.S. Cl. ..... 29/809; 29/812.5; 72/391.6

(58) Field of Classification Search ..... 29/434, 29/524.1, 798, 809, 812.5, 818, 433; 221/75, 221/89, 182, 168, 270, 277, 281, 312 A; 72/391.6; 227/107
See application file for complete search history.

(56) References Cited

U.S. PATENT DOCUMENTS 3,286,856 A * 11/1966 Greenlay et al. ..... 414/27
3,415,102 A * 12/1968 Elliott ..... 29/812.5
3,948,427 A 4/1976 Claydon et al.
4,027,520 A 6/1977 Klein
4,338,714 A * 7/1982 Powderly ..... 29/433
4,388,753 A * 6/1983 Brookes ..... 29/433
4,410,103 A 10/1983 Fuhrmeister
4,628,722 A 12/1986 Mauer et al.
4,643,344 A 2/1987 Kaita et al.
5,035,353 A 7/1991 Smart et al.
5,042,131 A 8/1991 Low
5,104,024 A 4/1992 Brewer et al.
5,390,524 A 2/1995 Higgs
5,813,114 A * 9/1998 Blacket et al. ..... 29/809

(Continued)

FOREIGN PATENT DOCUMENTS

GB 2 124 955 2/1984

(Continued)

*Primary Examiner*—David P Bryant
*Assistant Examiner*—Ryan J Walters
(74) *Attorney, Agent, or Firm*—Trexler, Bushnell, Giangiorgi, Blackstone & Marr, Ltd

(57) ABSTRACT

A rivet delivery apparatus and method which is configured to drop a rivet into a position such that the rivet can be threaded onto a guide wire and shot along the guide wire, such as to a rivet tool for broaching. Preferably, the rivet delivery apparatus includes a means to clamp the guide wire at two positions—a first position before a rivet is threaded onto the guide wire, and a second position after the rivet has been threaded onto the guide wire. Specifically, preferably the guide wire is clamped in a first position, and the rivet delivery apparatus includes a plate which shifts, causing a single rivet to fall in place for threading onto the guide wire. Then, the guide wire is unclamped, moved to the second position such that the rivet threads onto the guide wire, and the guide wire is clamped. Then, the rivet is shot along the guide wire, the guide wire is unclamped, moved to the first position, and clamped again so that a new rivet can be received and threaded onto the guide wire.

25 Claims, 16 Drawing Sheets

U.S. PATENT DOCUMENTS

| | | | | |
|---|---|---|---|---|
| 6,079,604 | A | 6/2000 | Banducci et al. | |
| 6,125,680 | A | 10/2000 | Bradbury et al. | |
| 6,240,613 | B1 | 6/2001 | O'Connor et al. | |
| 6,256,854 | B1 | 7/2001 | Chitty et al. | |
| 6,347,449 | B1 * | 2/2002 | Calkins et al. | 29/701 |
| 6,637,099 | B1 | 10/2003 | Seewraj | |
| 7,020,955 | B2 * | 4/2006 | Joseph et al. | 29/809 |
| 7,040,010 | B2 | 5/2006 | Bouman | |
| 2004/0194297 | A1 * | 10/2004 | Joseph et al. | 29/812.5 |

FOREIGN PATENT DOCUMENTS

| | | | |
|---|---|---|---|
| WO | 2004/076867 | A2 | 9/2004 |

* cited by examiner

RIVET DELIVERY APPARATUS AND METHOD

RELATED APPLICATION (PRIORITY CLAIM)

The present invention claims the benefit of U.S. Provisional Application Ser. No. 60/661,276, filed Mar. 11, 2005.

BACKGROUND OF THE INVENTION

The present invention generally relates to apparatuses and methods for delivering rivets such as to a rivet tool, and more specifically relates to a rivet delivery apparatus and method which can deliver rivets quickly and reliably.

OBJECTS SUMMARY

An object of an embodiment of the present invention is to provide a rivet delivery apparatus and method which is configured to deliver rivets reliably one rivet at a time, without the rivets becoming jammed.

Another object of an embodiment of the present invention is to provide a rivet delivery apparatus and method which is configured to quickly deliver rivets to a rivet tool, one rivet at a time.

Briefly, and in accordance with the foregoing, an embodiment of the present invention provides a rivet delivery apparatus and method which is configured to drop a rivet into a position such that the rivet can be threaded onto a guide wire and shot along the guide wire, such as to a rivet tool for broaching.

Preferably, the rivet delivery apparatus includes a means to clamp the guide wire at two positions—a first position before a rivet is threaded onto the guide wire, and a second position after the rivet has been threaded onto the guide wire. Specifically, preferably the guide wire is clamped in a first position, and the rivet delivery apparatus includes a plate which shifts, causing a single rivet to fall in place for threading onto the guide wire. Then, the guide wire is unclamped, moved to the second position such that the rivet threads onto the guide wire, and the guide wire is clamped. Then, the rivet is shot along the guide wire, the guide wire is unclamped, moved to the first position, and clamped again so that a new rivet can be received and threaded onto the guide wire.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DESCRIPTION OF AN EMBODIMENT OF THE INVENTION

Figure 1:
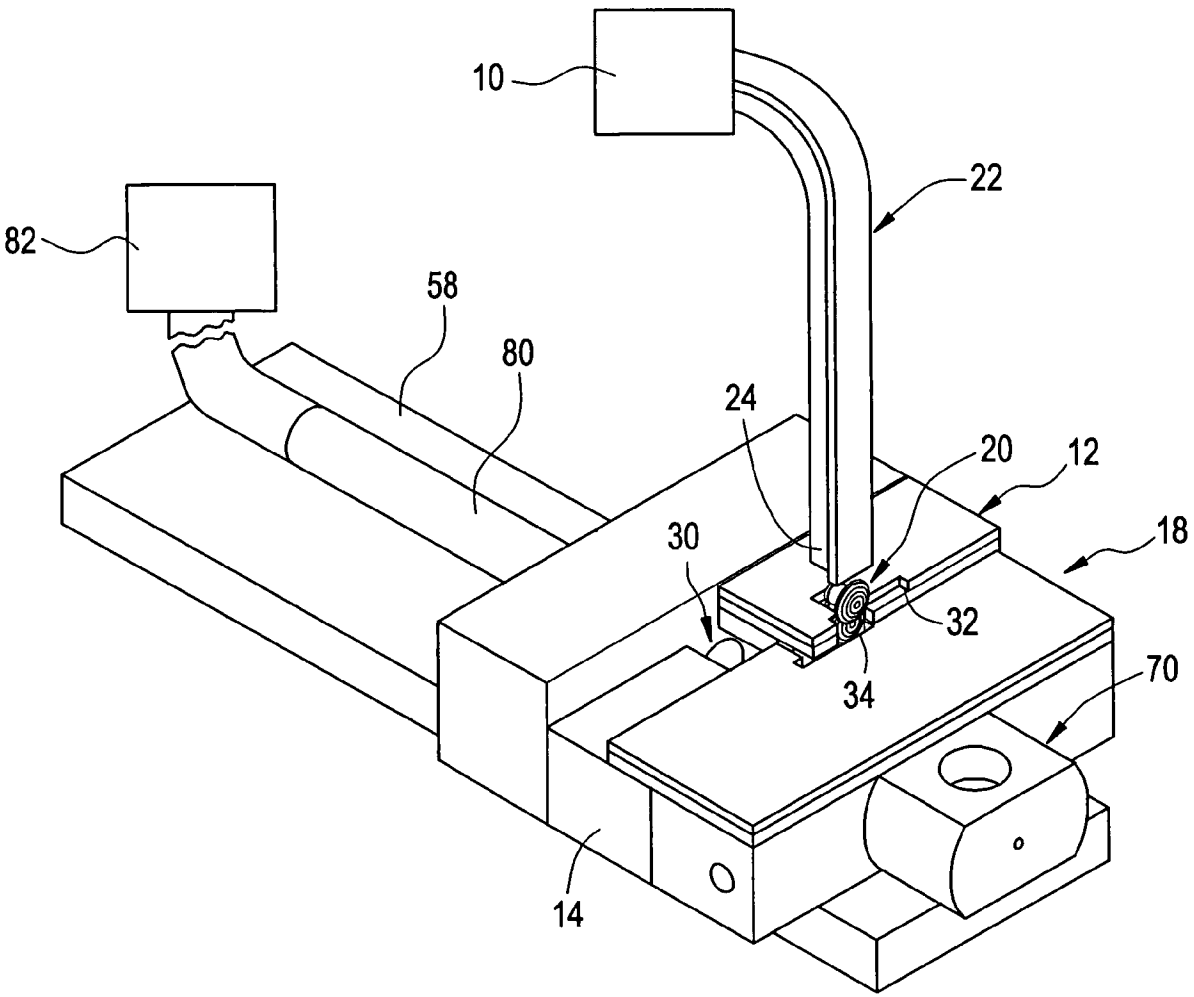
FIG. 1 illustrates a rivet delivery apparatus which is in accordance with an embodiment of the present invention.
Figure 2:
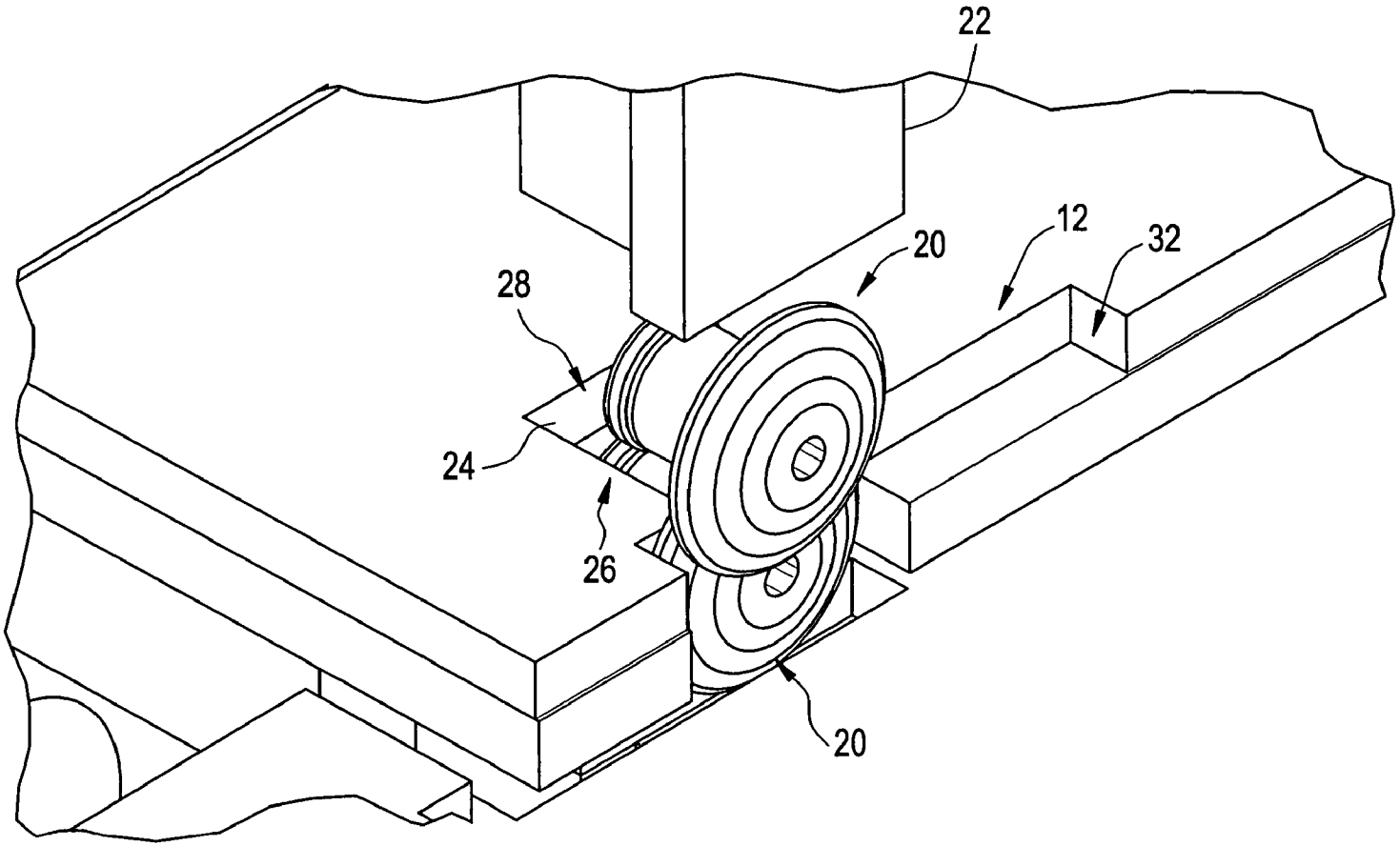
FIGS. 2 through 5 show how a gate of the rivet delivery apparatus moves to deliver a rivet to guide blocks.
Figure 3:
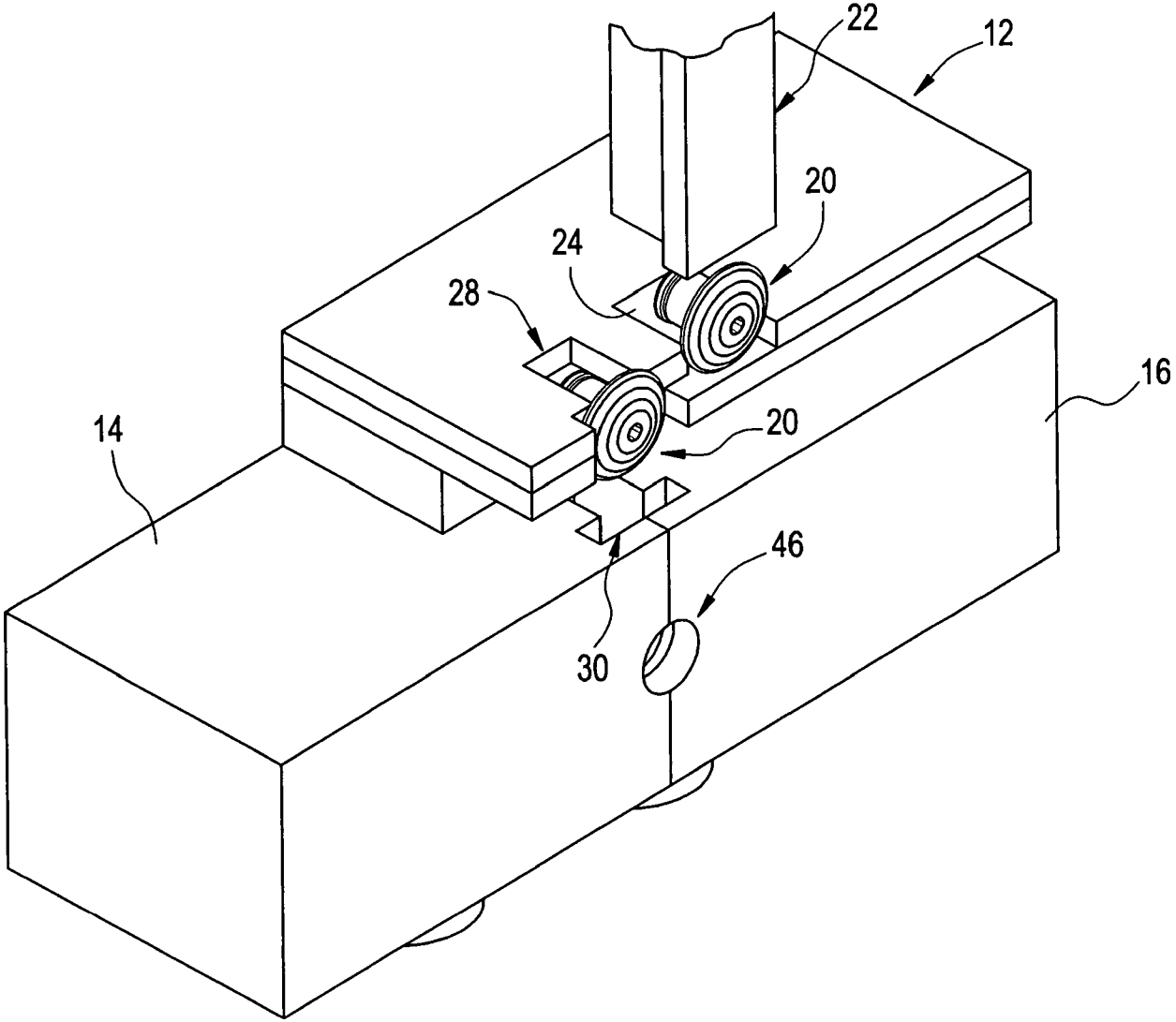

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

FIG. 1 illustrates a rivet orienting device 10 as well as a gate 12 and guide blocks 14,16 of a rivet delivery apparatus 18 which is in accordance with an embodiment of the present invention. As shown, a rivet orienting device (represented by box 10), such as a bowl, provides rivets 20 to a vibrating feed rail 22. An end 24 of the feed rail 22 provides an opening 26 which generally corresponds to the shape of the rivets 20. The rivet delivery apparatus 18 includes a moveable gate 12. The moveable gate 12 provides an opening 28 which is similar to the opening 26 in the end 24 of the feed rail 22. As shown in FIGS. 2 through 5, the moveable gate 12 is shiftable from a position where the opening 28 is generally aligned under the opening 26 in the end 24 of the feed rail 22, to a position where the opening 28 is generally aligned over an opening 30 which is provided in guide blocks 14, 16. Hence, the moveable gate 12 is shiftable to provide rivets 20, one at a time, from the end 24 of the feed rail 22 to the guide blocks 14, 16 in the moveable gate 12 and guide blocks 14, 16. By providing that the openings 26, 28, 30 generally correspond to the shape of the rivets 20, the rivets 20 do not tend to topple or get jammed. The moveable gate 12 shifts when the guide blocks 14, 16 are opened and closed (FIG. 1 shows the guide blocks 14, 16 closed, and FIG. 5 shows the guide blocks 14, 16 open). Additionally, the opening 28 in the moveable gate 12 includes a cutout 32 for receiving and aligning the head 34 of the rivet 20. Specifically, the moveable gate 12 may be keyed to the left guide block 14 such that when the guide blocks 14, 16 are closed, the opening 28 in the moveable gate 12 is positioned and aligned under the opening 26 in the end 24 of the feed rail 22, as shown in FIG. 1, and when the guide blocks 14, 16 are open, the opening 28 in the moveable gate 12 is positioned and aligned over the opening 30 in the guide blocks 14, 16 as shown in FIG. 5.

Figure 6:
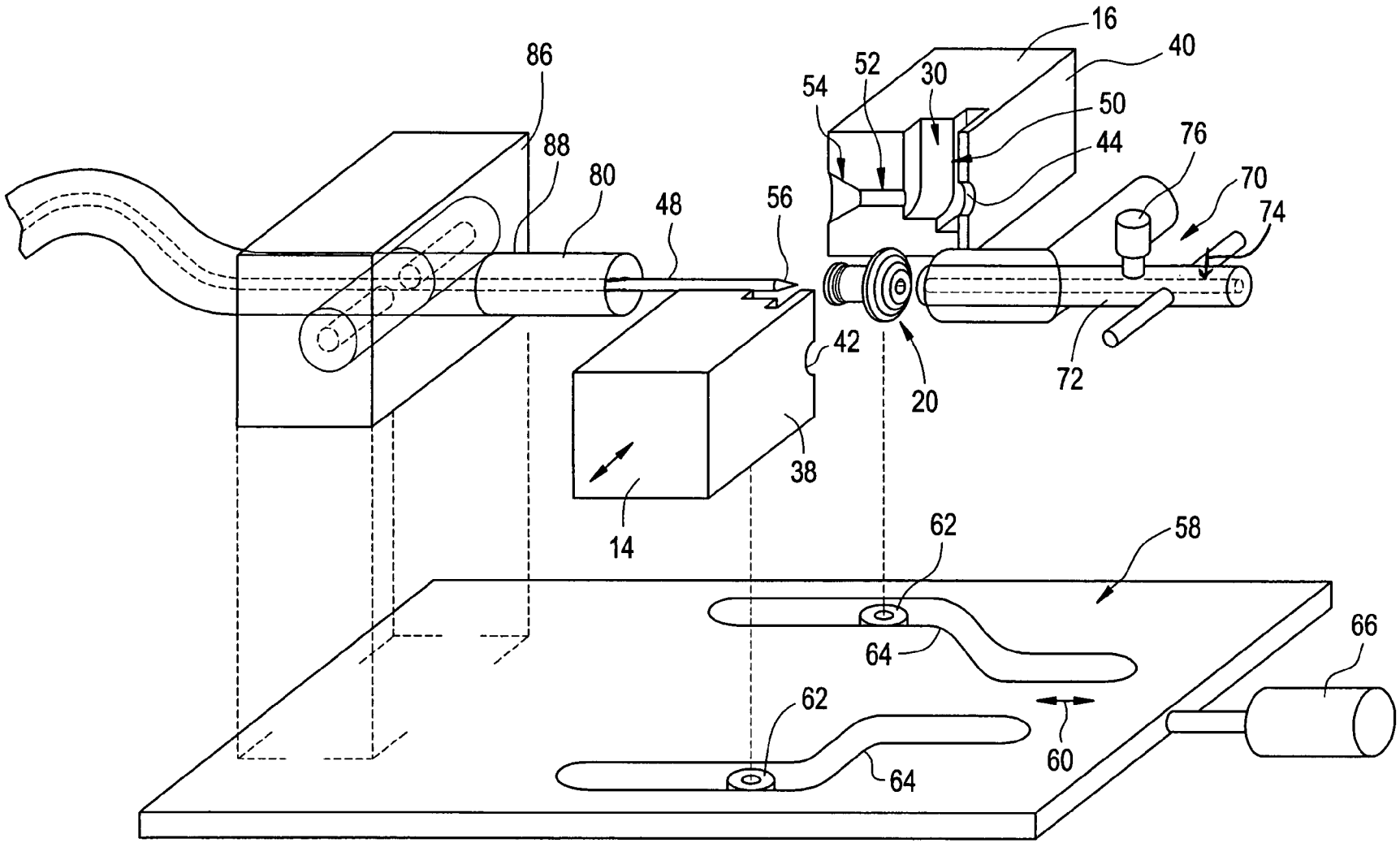
FIG. 6 is a partially exploded view of the rivet delivery apparatus.

As shown in FIG. 6, each guide block 14, 16 preferably has a front surface 38, 40 that provides a notch 42, 44. When the guide blocks 14, 16 are closed, the notches 42, 44 come together to form a circular opening 46 (see FIG. 3) which is large enough to allow a guide wire 48 to travel therethrough, but is too small to allow a head 34 of a rivet 20 to pass therethrough.

Figure 7:
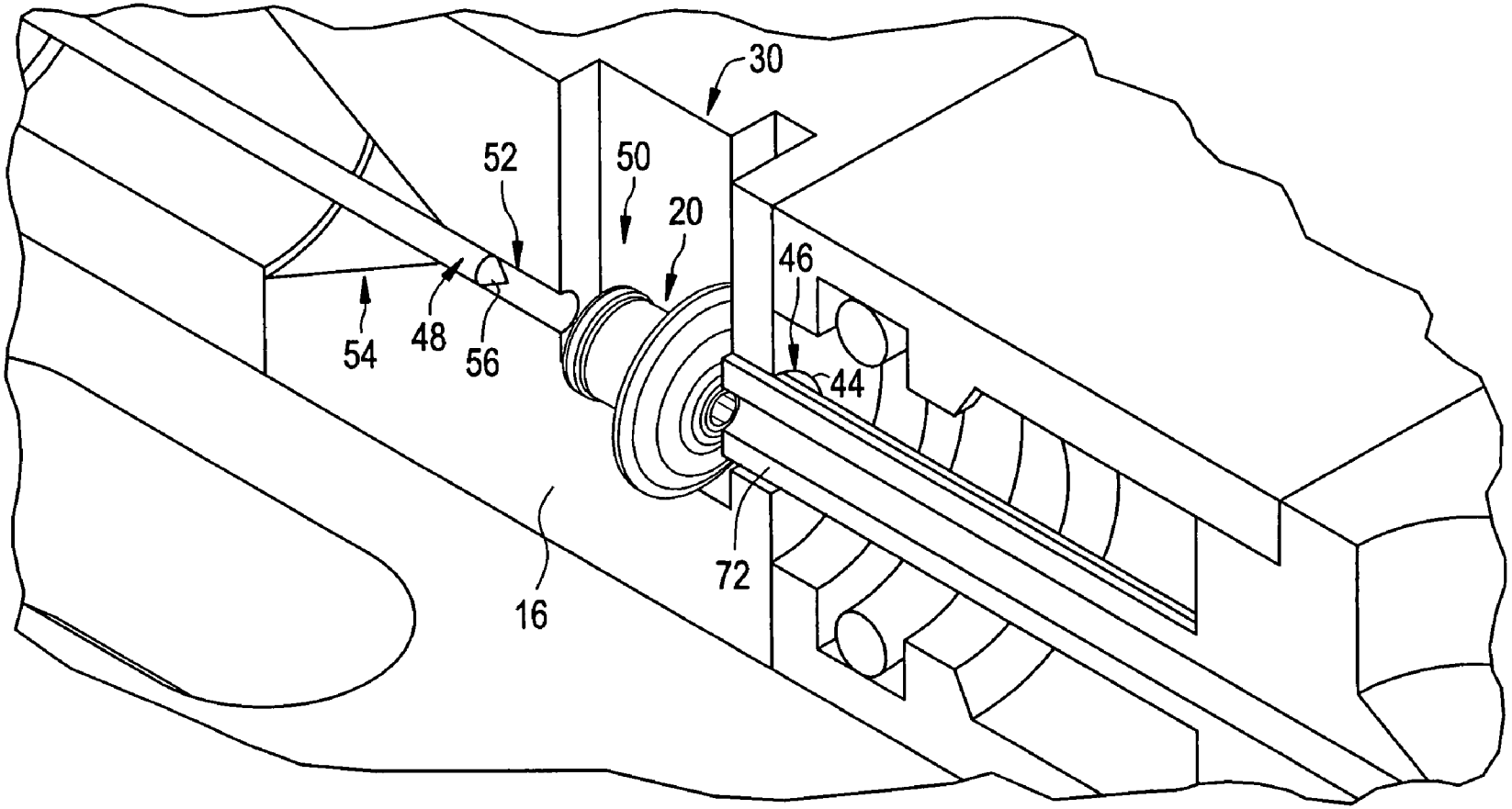
FIG. 7 shows a rivet in the guide blocks of the rivet delivery apparatus.
Figure 8:
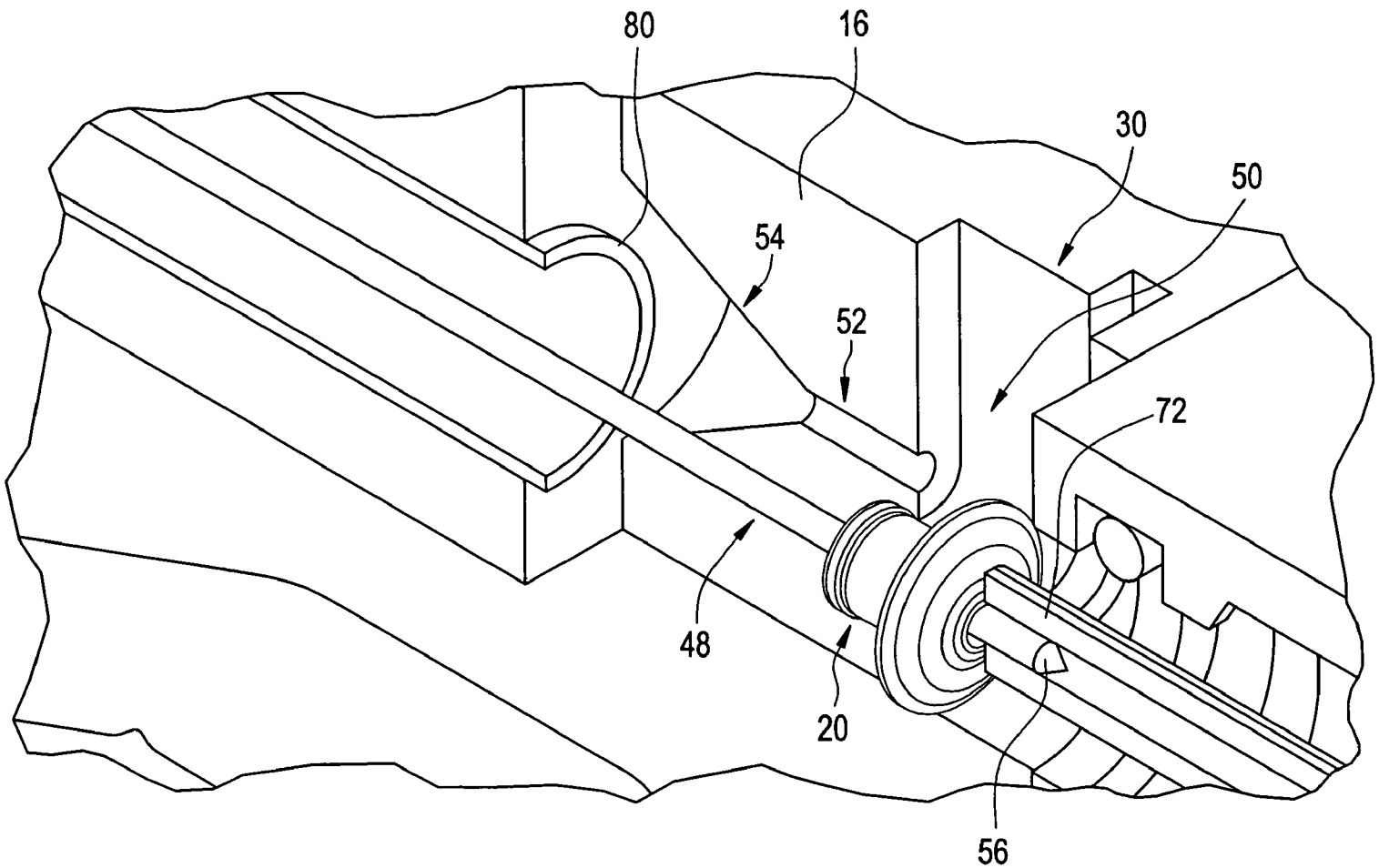
FIG. 8 shows a guide wire threaded through the rivet.

Each guide block 14, 16 has a cut out profile which provides a rivet well 50, a guide wire passageway 52, and preferably a funnel cut out section 54. The rivet well 50 is configured to receive a rivet 20 from the moveable gate 12 such that the rivet 20 drops down in the well 50 with the head 34 of the rivet 20 pointing toward the opening 46, as shown in FIGS. 6 and 7. The guide wire passageway 52 is in communication with the rivet well 50, and the funnel cut out 54 is provided in communication with the guide wire passageway 52. The funnel portion 54 tends to direct an end 56 of a guide wire 48 into the guide wire passageway 52, as shown in FIG. 7, and the guide wire passageway 52 leads the guide wire 48 to, and through, a rivet 20 which is disposed in the rivet well 50, as shown in FIG. 8, such that the rivet 20 threads onto the guide wire 48 and the end 56 of the guide wire extends out the opening 46.

The guide blocks 14, 16 are mounted on a slide plate 58, and the slide plate 58 is mounted on a track plate (not shown) such that the slide plate 58 can translate along a single axis, and is generally prevented from moving along either other axis. Specifically, the slide plate 58 can slide back and forth as represented by arrow 60 in FIG. 6, but not in any other direction relative to the track plate. The track plate is preferably further secured to a base plate (not shown).

The guide blocks 14, 16 include projections or cam followers 62 which are secured to the track plate and extend through slots 64 in the slide plate 58 such that when the slide plate 58 slides back and forth, the guide blocks 14, 16 open and close. Preferably, the slide plate 58 is connected to an air cylinder 66 which is operable to selectively slide the slide plate 58 back and forth and open and close the guide blocks 14, 16.

Figure 9:
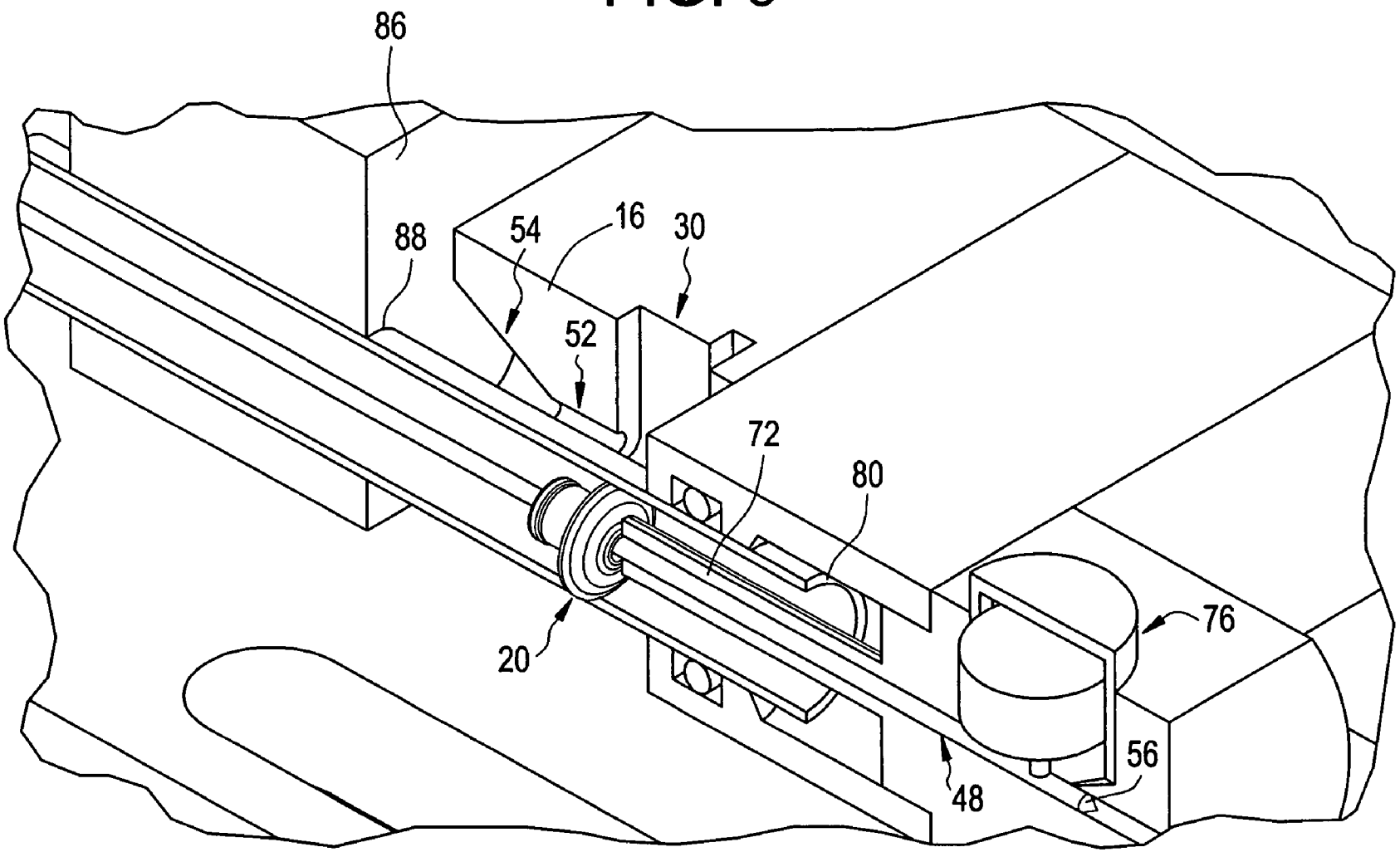
FIG. 9 shows the guide wire advanced and clamped.
Figure 10:
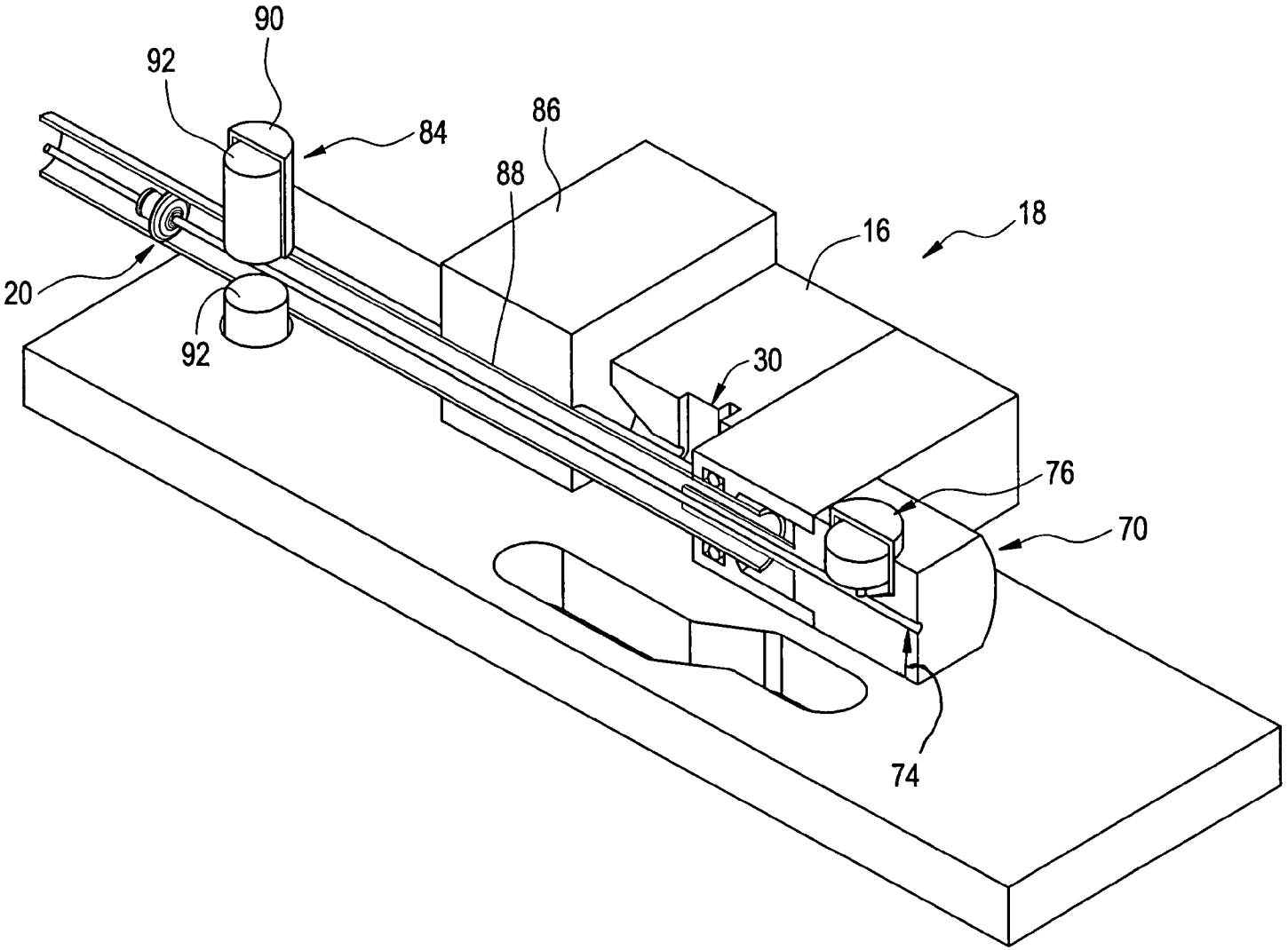
FIG. 10 is a perspective view which shows the rivet being blown along the guide wire.

Preferably, a stationary push tube assembly 70 is provided, and the assembly 70 includes a push tube 72. As shown in FIG. 10, the stationary push tube assembly 70 also includes a sensor (represented by arrow 74), such as a photo eye, for sensing the guide wire 48, and one or more wire clamp cylinders 76 which are configured to selectively clamp and unclamp the guide wire 48 (see FIGS. 9 and 13). The stationary push tube assembly 70 also includes an air supply inlet 78 for receiving air from an air supply (represented by box 79) for blowing a rivet 20 along the guide wire 48 and into a rivet supply tube 80 which is connected to a rivet tool (represented by box 82 in FIG. 14).

Figure 11:
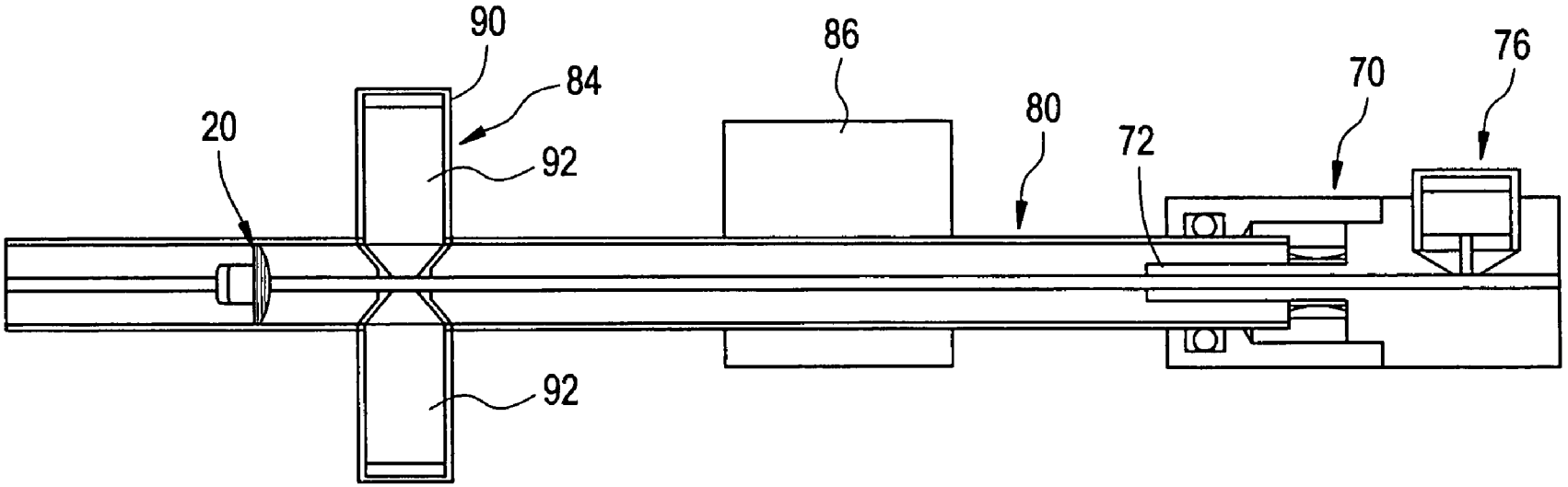
FIG. 11 is similar to FIG. 10, but provides a side view.
Figure 12:
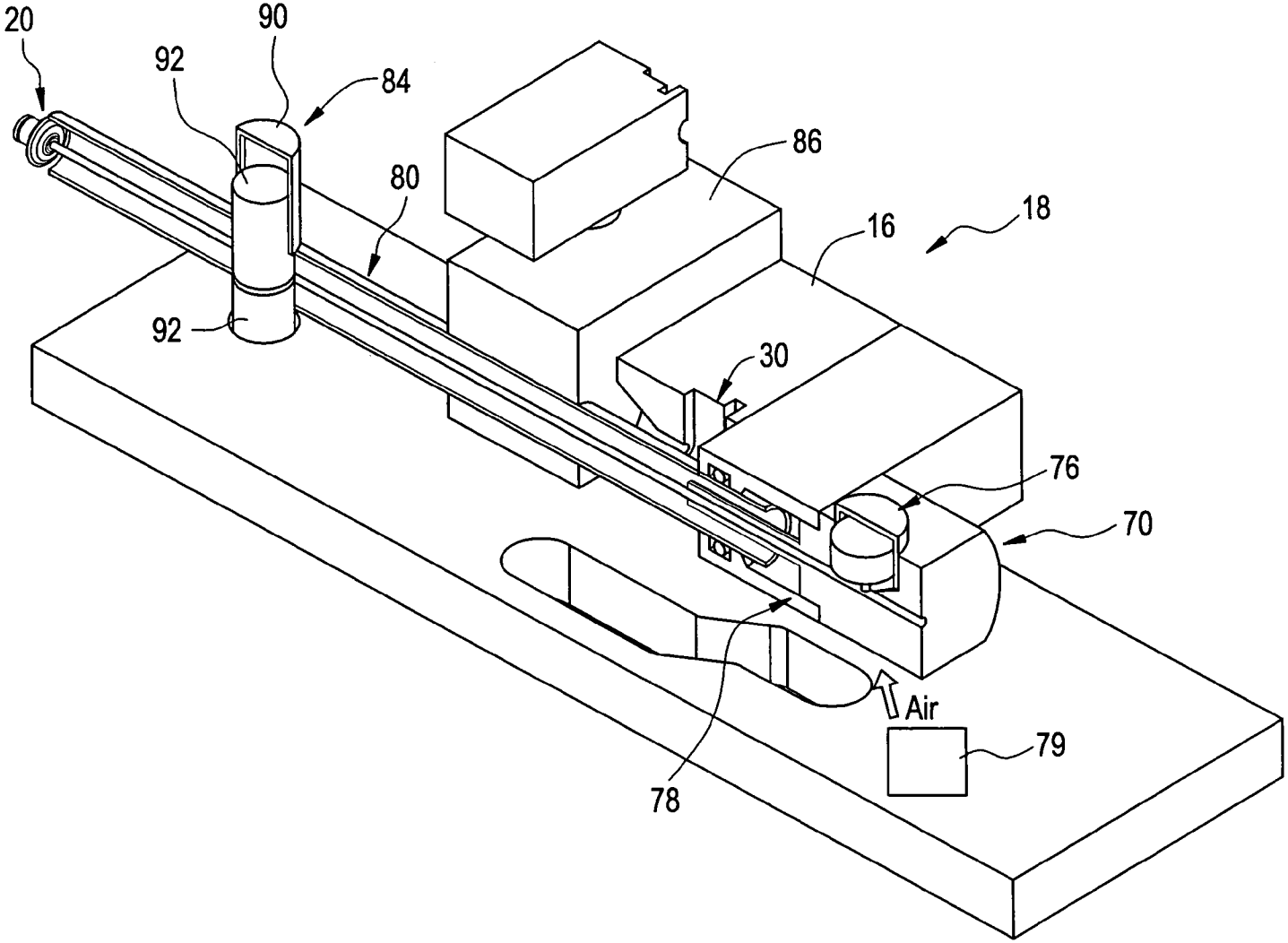
FIG. 12 is similar to FIG. 10, but shows the guide wire clamped by a wire clamp provided on a slide block and guide blocks in an open position.

As shown in FIG. 6, preferably one or more wire clamp cylinders 84 are provided on the slide plate 58, as well as a support block 86 which includes a through bore 88 through which the rivet supply tube 80 extends. The wire clamp cylinders 84 are configured to selectively clamp and unclamp the guide wire 48 (see FIGS. 10 and 12). As shown in FIGS. 10 and 12, a single wire clamp cylinder 84 can be provided which consists of a cap 90 and plungers 92 disposed therein, which are moveable in the cap 90 to clamp the guide wire 48 as shown in the progression from FIG. 10 to FIG. 12.

Figure 4:
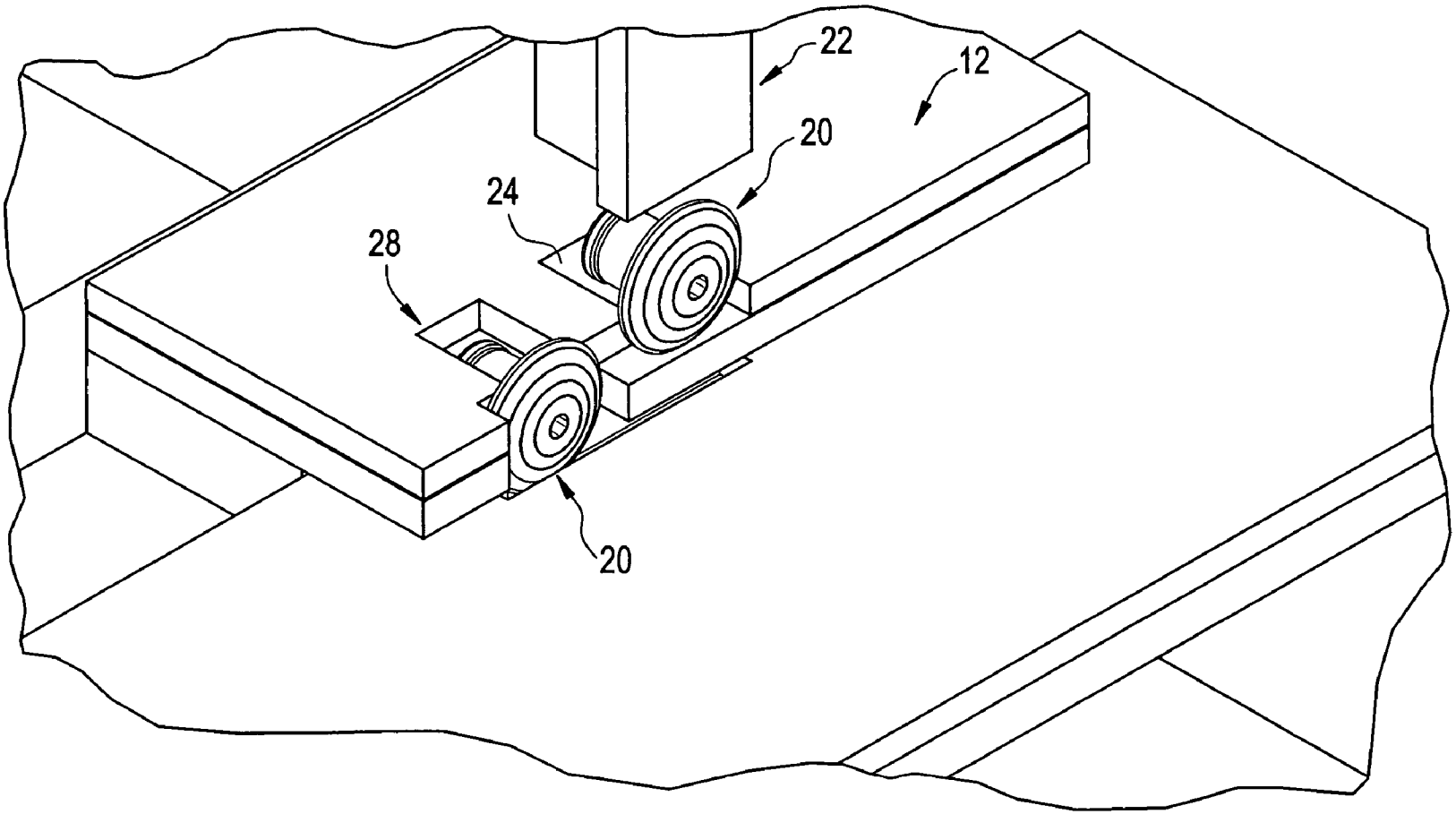
Figure 5:
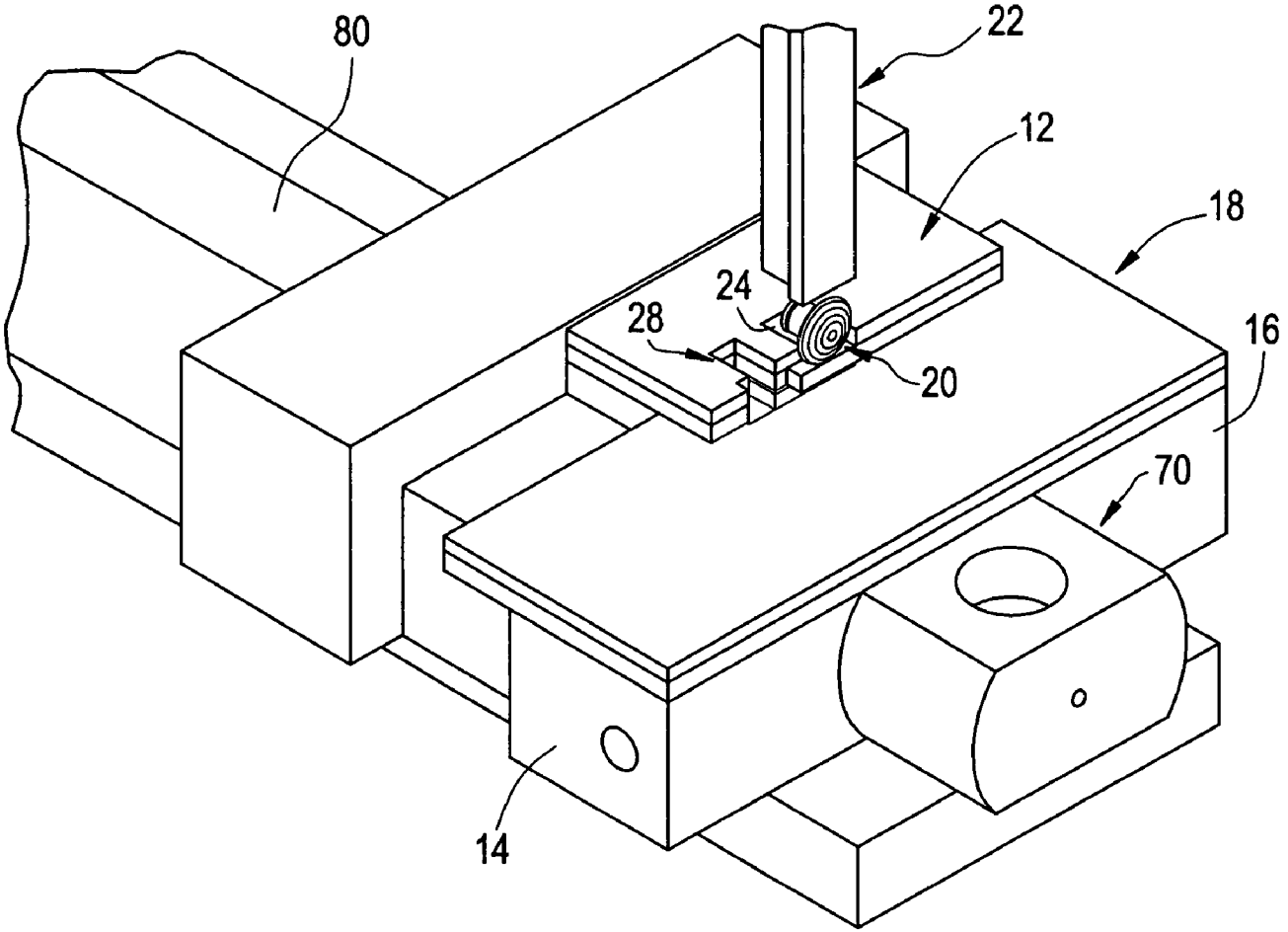
Figure 13:
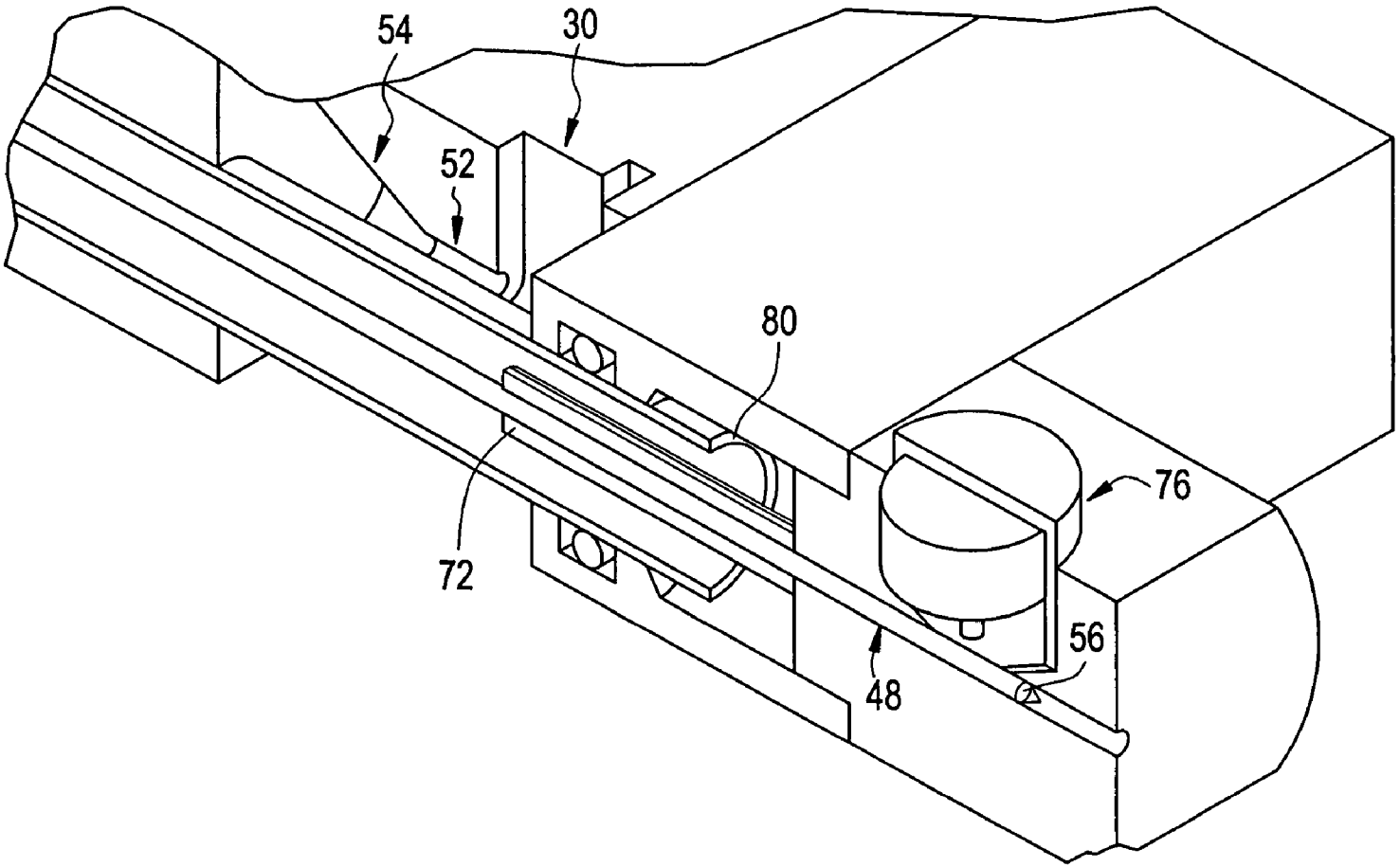
FIG. 13 shows the guide wire clamped by a wire clamp provided in a push tube assembly.
Figure 14:
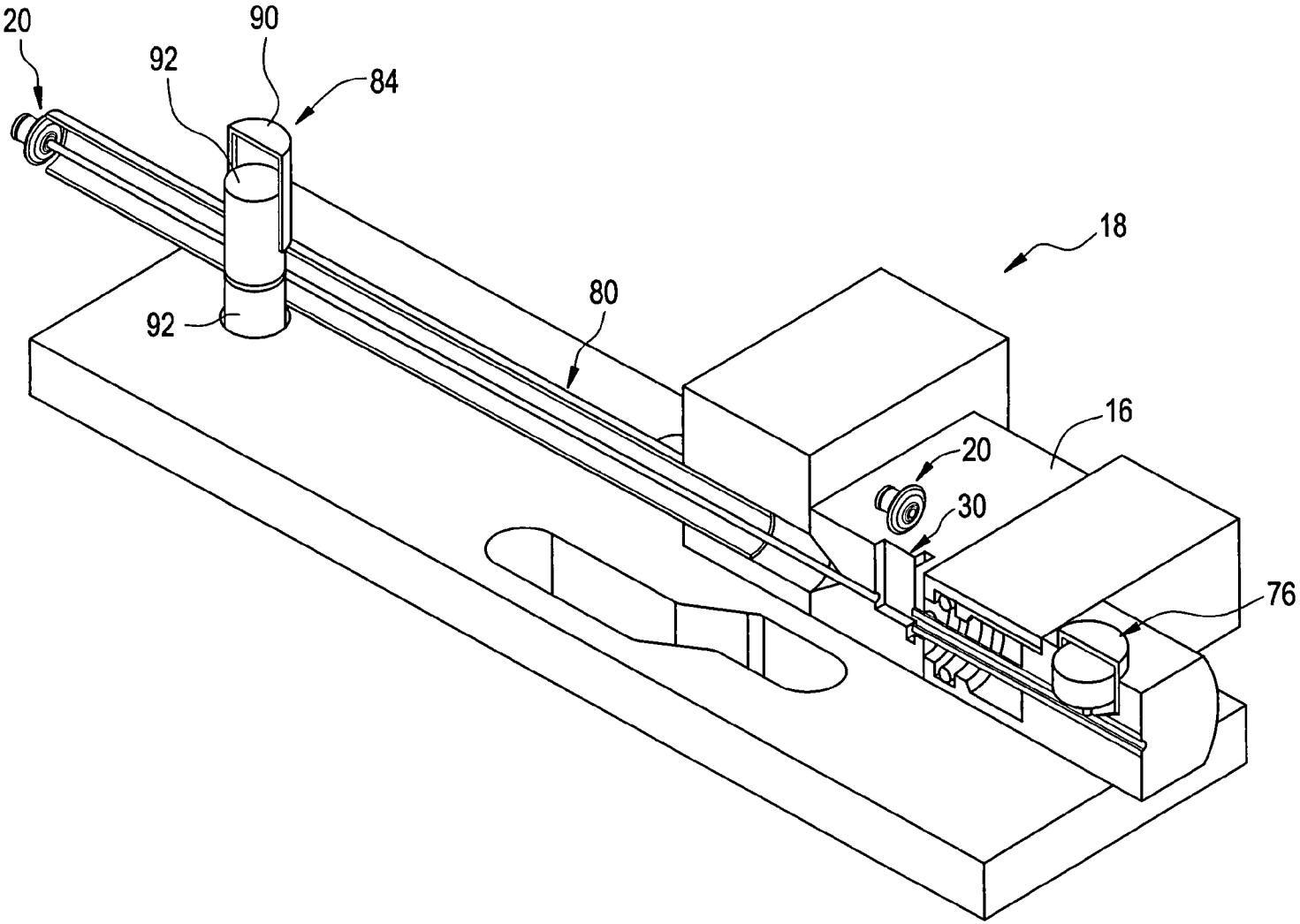
FIG. 14 is similar to FIG. 12, but shows the guide blocks in the closed position.

Since the wire clamp cylinder 84 is mounted to the slide plate 58, when the guide wire 48 is clamped and the slide plate 58 is slid to the right as shown in FIG. 4, the end 56 of the guide wire 48 is moved toward the stationary push tube 72, into the funnel 54 and guide wire passageway 52 provided in the guide blocks 14, 16, through the rivet 20 which is disposed in the rivet well 50, and into the stationary push tube 72. As the slide plate 58 is slid to the right as shown in FIG. 4, the left-most end of the slots 64 move toward the cam followers 62 of the guide blocks 14, 16, and the guide blocks 14, 16 open, as shown in FIG. 13. Once the guide wire 48 has been threaded through the rivet 20, and the sensor 74 senses the guide wire 48, the guide wire 48 is clamped by the one or more wire clamp cylinders 76 in the stationary push tube assembly 70 (see FIG. 9) and is unclamped by the one or more wire clamp cylinders 84 on the slide plate 58 (see FIG. 10). Then, air is supplied through the air supply inlet 78 to blow the rivet 20 along the guide wire 48, to the rivet tool 82.

Once the rivet 20 has been blown into and through the rivet supply tube 80, the guide wire 48 is clamped by the one or more clamp cylinders 84 provided on the slide plate 58 and unclamped by the one or more wire clamp cylinders 76 in the stationary push tube 72. Then, the slide plate 58 is slid to the left as shown in FIG. 6, causing the right-most end of the slots 64 to move toward the cam followers 62 of the guide blocks 14, 16, causing the guide blocks 14, 16 to close, as shown in FIG. 1. Because the guide wire 48 is clamped by the clamp cylinder(s) 84 provided on the slide plate 58, the end 56 of the guide wire 48 is pulled out of the stationary push tube 72 and the rivet well 50 provided in the guide blocks 14, 16. Thereafter, another rivet 20 can be received by the guide blocks 14, 16 (see FIG. 7) and thereafter threaded on the guide wire 48 (see FIGS. 8 and 9) for subsequent air transport through the rivet supply tube 80.

Figure 15:
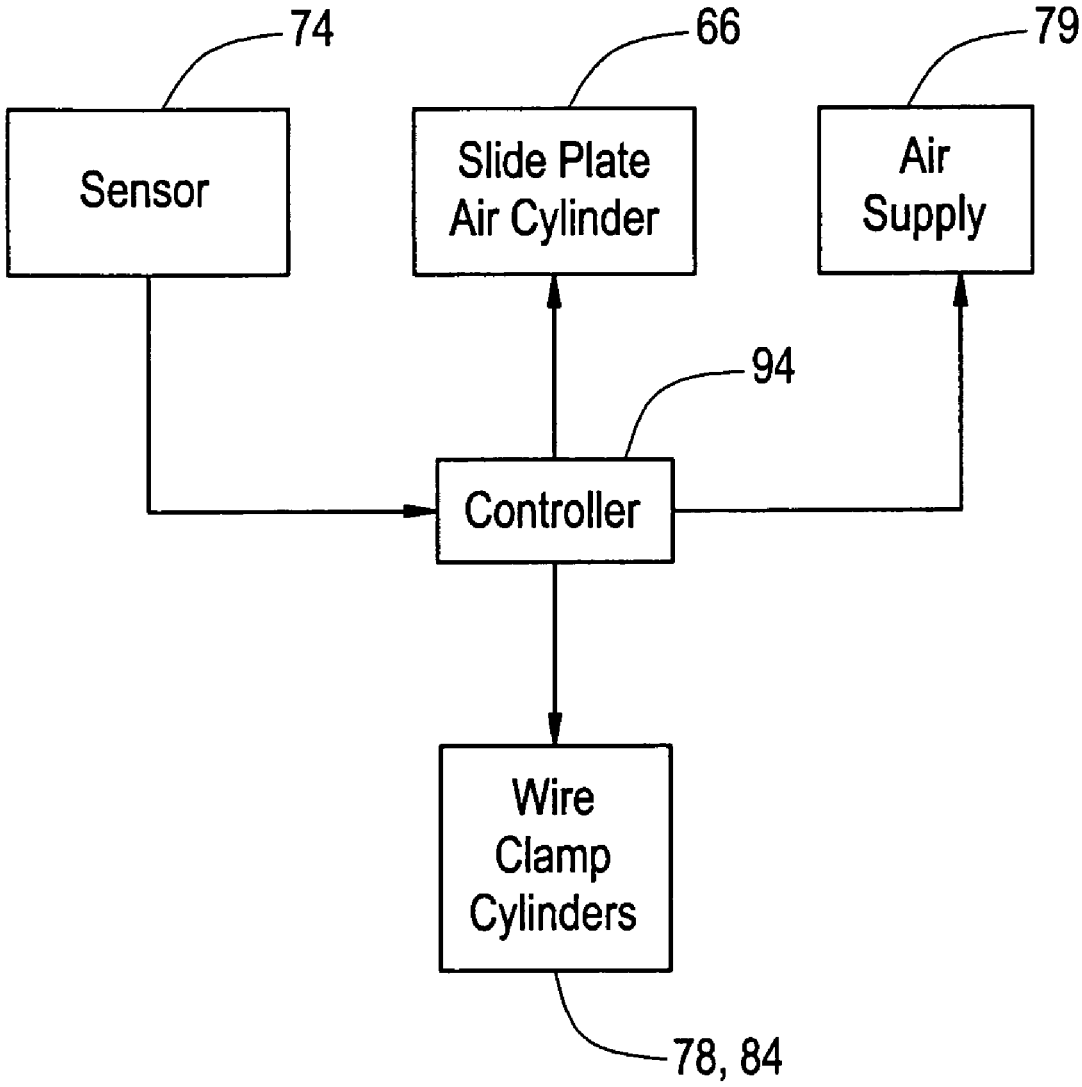
FIG. 15 shows a control system associated with the rivet delivery apparatus.

Preferably, as shown in FIG. 15, the sensor 74 in the stationary push tube 72 is connected to a controller 94 which is operably connected to the air cylinder 66 that moves the slide plate 58, the air supply 79 which provides air to the air supply inlet 78, and the wire clamp cylinders 76, 84. Preferably, the controller 94 is configured to move the slide plate 58, provide air to the air supply inlet 78, and actuate the wire clamp cylinders 76, 84, in the appropriate manner and at the appropriate times during the process.

Figure 16:
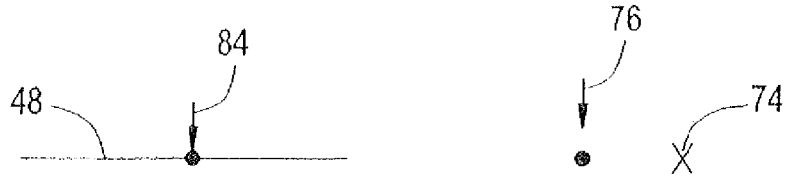
FIGS. 16-20 provide simplified views which illustrate the rivet delivery process.
Figure 17:
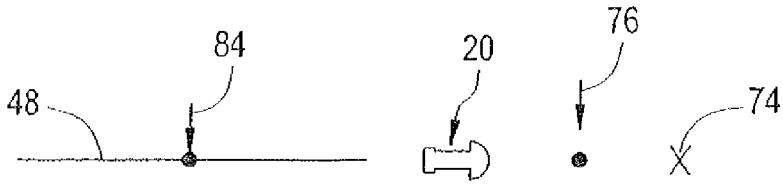
Figure 18:
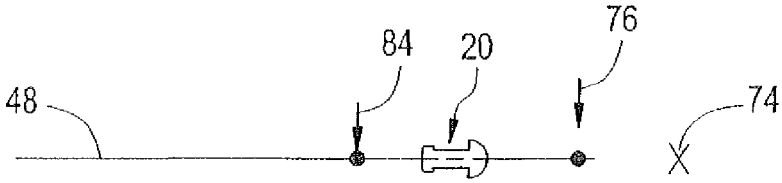
Figure 19:
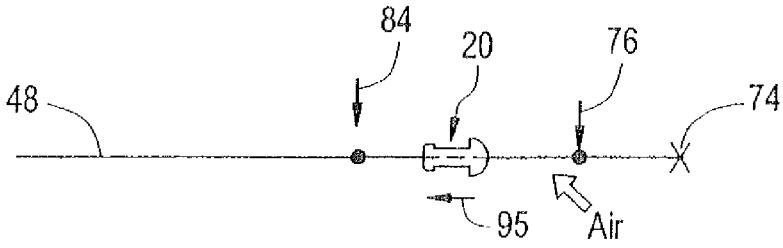
Figure 20:
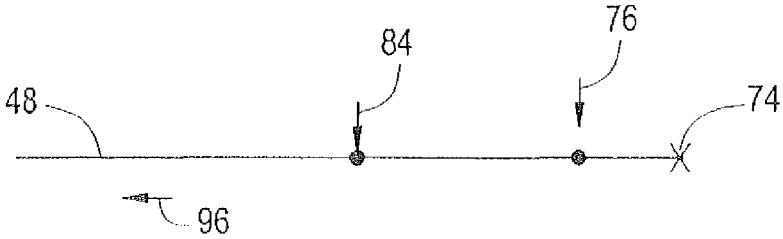

FIGS. 16-20 provide simplified views which illustrate the rivet delivery process, wherein arrow 84 represents the wire clamp(s) which is/are contained on the slide plate 58, arrow 76 represents the wire clamp(s) which is/are contained in the stationary push tube 72, and the "x" represents the sensor 74 in the stationary push tube 72. As shown in FIG. 16, initially the guide wire 48 is clamped by the wire clamp(s) 84 on the slide plate 58 (see FIG. 12), then a rivet 20 is delivered as shown in FIG. 17 (see FIG. 3). Then, as shown in FIG. 18, the guide wire 48 is advanced (see FIG. 8) to thread the rivet 20 onto the guide wire 48. Then, as shown in FIG. 19, once the sensor 74 in the stationary push tube 72 senses the guide wire 48, the guide wire 48 is clamped by the wire clamp(s) 76 which is/are contained in the stationary push tube assembly 70 (see FIG. 9) and is unclamped by the wire clamp(s) 84 on the slide plate 58 (see FIG. 10). Then, air is blown through the air inlet 78 to drive the rivet 20 along the guide wire 48 (indicated by arrow 95) to the rivet tool 82. Then, as shown in FIG. 20, the guide wire 48 is unclamped by the wire clamp(s) 76 which is/are contained in the stationary push tube assembly 70 (see FIG. 7) and is clamped by the wire clamp(s) 84 on the slide plate 58 (see FIG. 10). Then, the guide wire 48 is retracted (indicated by arrow 96), and another rivet 20 can be received.

While an embodiment of the invention is shown and described, it is envisioned that those skilled in the art may devise various modifications without departing from the spirit and scope of the foregoing description.

What is claimed is:

1. A rivet delivery apparatus for delivering a rivet comprising: a guide wire; a first clamper configured to contactably clamp onto the guide wire at a first location on the guide wire and move the guide wire from a first position to a second position, during which time the guide wire threads into the rivet; a second clamper configured to contactably clamp the guide wire at a second location on the guide wire once the rivet is on the guide wire; an air supply; and an air supply inlet, wherein the air supply inlet is configured such that air from the air supply flows through the air supply inlet to the rivet on the guide wire, wherein the rivet delivery apparatus is configured to blow the rivet along the guide wire by the air supply while the guide wire is being clamped by the second clamper.

2. A rivet delivery apparatus as recited in claim 1, wherein the rivet delivery apparatus is configured to clamp the guide wire at the first location on the guide wire before the rivet is threaded onto the guide wire, and at the second location on the guide wire after the guide wire has been threaded into the rivet.

3. A rivet delivery apparatus as recited in claim 1, further comprising a shiftable plate, wherein shifting of the plate causes a single rivet to fall in place for threading onto the guide wire.

4. A rivet delivery apparatus as recited in claim 1, further comprising a moveable gate which has an opening 14 receiving a rivet, and guide blocks which have an opening for receiving the rivet from the moveable gate.

5. A rivet delivery apparatus as recited in claim 4, wherein the moveable gate is keyed to one of the guide blocks.

6. A rivet delivery apparatus as recited in claim 1, further comprising a feed rail, a moveable gate which has an opening for receiving a rivet from the feed rail, and guide blocks which have an opening for receiving the rivet from the moveable gate.

7. A rivet delivery apparatus as recited in claim 6, wherein the moveable gate is configured to move from a position where the opening in the moveable gate is positioned under the feed rail to a position where the opening in the moveable gate is positioned over the opening in the guide blocks.

8. A rivet delivery apparatus as recited in claim 7, wherein the rivet delivery apparatus is configured such that the guide blocks are openable and closeable.

9. A rivet delivery apparatus as recited in claim 8, wherein each guide block has a surface which provides a notch, wherein when the guide blocks are closed notches come together to form a circular opening which is large enough to allow to guide wire to travel therethrough.

10. A rivet delivery apparatus as recited in claim 8, wherein each guide block has a cut out profile which provides a rivet well for receiving a rivet from the moveable gate, and a guide wire passageway in communication with the rivet well.

11. A rivet delivery apparatus as recited in claim 10, wherein each guide block provides a funnel section which is configured to guide an end of the guide wire into the guide wire passageway.

12. A rivet delivery apparatus as recited in claim 8, further comprising a slide plate configured to move back and forth along a single axis, wherein said guide blocks are mounted on the slide plate such that the guide blocks open and close when the slide plate moves back and forth.

13. A rivet delivery apparatus as recited in claim 12, further comprising an air cylinder which is connected to the slide plate and is configured to move the slide plate back and forth.

14. A rivet delivery apparatus as recited in claim 8, further comprising a sensor configured to sense the guide wire.

15. A rivet delivery apparatus as recited in claim 8, wherein each of the first and second clampers comprise a wire clamp cylinder configured to clamp the guide wire.

16. A rivet delivery apparatus as recited in claim 15, further comprising a slide plate configured to move back and forth along a single axis, wherein said guide blocks are mounted on the slide plate such that the guide blocks open and close when the slide plate moves back and forth, an air cylinder which is connected to the slide plate and is configured to move the slide plate back and forth.

17. A rivet delivery apparatus as recited in claim 16, further comprising a controller which is connected to and is configured to control the air cylinder and the first and second clampers.

18. A rivet delivery apparatus for delivering a rivet comprising: a guide wire; a first clamper configured to contactably clamp onto the guide wire at a first position and thread the guide wire into the rivet; a second clamper configured to contactably clamp onto the guide wire at a second position; a slide plate configured to move back and forth along a single axis; guide blocks which are mounted on the slide plate such that the guide blocks open and close when the slide plate moves back and forth; an air supply; and an air supply inlet, wherein the air supply inlet is configured such that air from the air supply flows through the air supply inlet to the rivet on the guide wire, wherein the rivet delivery apparatus is configured to blow the rivet along the guide wire by the air supply while the guide wire is being clamped by the second clamper.

19. A rivet delivery apparatus as recited in claim 18, further comprising an air cylinder which is connected to the slide plate and is configured to move the slide plate back and forth.

20. A rivet delivery apparatus for delivering a rivet comprising: a guide wire; a first wire clamp cylinder configured to contactably clamp onto the guide wire at a first position and thread the guide wire into the rivet; a second wire clamp cylinder configured to contactably clamp onto the guide wire at a second position; a slide plate configured to move back and forth along a single axis; guide blocks which are mounted on the slide plate such that the guide blocks open and close when the slide plate moves back and forth; an air cylinder which is connected to the slide plate and is configured to move the slide plate back and forth; an air supply; and an air supply inlet, wherein the air supply inlet is configured such that air from the air supply flows through the air supply inlet to the rivet on the guide wire, wherein the rivet delivery apparatus is configured to blow the rivet along the guide wire by the air supply while the guide wire is being clamped by the second wire clamp cylinder.

21. A rivet delivery apparatus as recited in claim 20, further comprising a controller which is connected to and is configured to control the air cylinder and the wire clamp cylinders.

22. A rivet delivery apparatus for delivering a rivet comprising: a guide wire; a first clamper configured to contactably clamp onto the guide wire at a first location on the guide wire and move the guide wire from a first position to a second position, during which the guide wire threads into the rivet; and a second clamper configured to contactably clamp the guide wire at a second location on the guide wire once the rivet is on the guide wire; further comprising a feed rail, a moveable gate which has an opening for receiving a rivet from the feed rail, and guide blocks which have an opening for receiving the rivet from the moveable gate, wherein the moveable gate is configured to move from a position where the opening in the moveable gate is positioned under the feed rail to a position where the opening in the moveable gate is positioned over the opening in the guide blocks, wherein the rivet delivery apparatus is configured such that the guide blocks are openable and closeable, further comprising a slide plate configured to move hack and forth along a single axis, wherein said guide blocks are mounted on the slide plate such that the guide blocks open and close when the slide plate moves back and forth.

23. A rivet delivery apparatus as recited in claim 22, further comprising an air cylinder which is connected to the slide plate and is configured to move the slide plate back and forth.

24. A rivet delivery apparatus for delivering a rivet comprising: a guide wire; a first clamper configured to contactably clamp onto the guide wire at a first location on the guide wire and move the guide wire from a first position to a second position, during which the guide wire threads into the rivet; and a second clamper configured to contactably clamp the guide wire at a second location on the guide wire once the rivet is on the guide wire; further comprising a feed rail, a moveable gate which has an opening for receiving a rivet from the feed rail, and guide blocks which have an opening for receiving the rivet from the moveable gate, wherein the moveable gate is configured to move from a position where the opening in the moveable gate is positioned under the feed rail to a position where the opening in the moveable gate is positioned over the opening in the guide blocks, wherein the rivet delivery apparatus is configured such that the guide blocks are openable and closeable, further comprising a slide plate configured to move back and forth along a single axis, wherein said guide blocks are mounted on the slide plate such that the guide blocks open and close when the slide plate moves back and forth, an air cylinder which is connected to the slide plate and is configured to move the slide plate back and forth.

25. A rivet delivery apparatus as recited in claim 24, further comprising a controller which is connected to and is configured to control the air cylinder and the first and second clampers.

* * * * *